US006625909B1

(12) United States Patent
Miller et al.

(10) Patent No.: US 6,625,909 B1
(45) Date of Patent: Sep. 30, 2003

(54) COUPLER FOR BUCKET EXCAVATORS

(76) Inventors: Doreen Jacqueline Miller, Addison Industrial Estate, Blaydon, Tyne & Wear (GB), NE21 4TE; Gary Miller, Addison Industrial Estate, Blaydon, Tyne & Wear (GB), NE21 4TE; Donald Keith Miller, Addison Industrial Estate, Blaydon, Tyne & Wear (GB), NE21 4TE ( * ) Notice: Subject to any disclaimer, the term of this patent is extended or adjusted under 35 U.S.C. 154(b) by 0 days.

(21) Appl. No.: 09/786,796

(22) PCT Filed: Jul. 1, 1999

(86) PCT No.: PCT/GB99/02096

§ 371 (c)(1),
(2), (4) Date: Jun. 22, 2001

(87) PCT Pub. No.: WO00/14343

PCT Pub. Date: Mar. 16, 2000

(30) Foreign Application Priority Data

Sep. 8, 1998 (GB) ..... 9819596

(51) Int. Cl.[7] ..... E02F 3/32
(52) U.S. Cl. ..... 37/468; 414/723
(58) Field of Search ..... 37/468; 414/723; 403/320, 321, 325; 172/272–275

(56) References Cited

U.S. PATENT DOCUMENTS

| | | | | |
|---|---|---|---|---|
| 4,297,074 A | | 10/1981 | Ballinger | |
| 4,355,945 A | | 10/1982 | Pilch | |
| 4,373,852 A | | 2/1983 | Maurer | |
| 4,459,768 A | | 7/1984 | Albrecht | |
| 4,854,814 A | | 8/1989 | Smith et al. | |
| 4,871,292 A | | 10/1989 | Milanowski | |
| 5,179,794 A | | 1/1993 | Ballinger | |
| 5,332,353 A | | 7/1994 | Arnold | |
| 5,581,917 A | | 12/1996 | Barden | |
| 5,634,736 A | | 6/1997 | Brown et al. | |
| 5,692,325 A | | 12/1997 | Kuzutani | |
| 6,254,331 B1 | * | 7/2001 | Pisco et al. | 414/723 |
| 6,422,805 B1 | * | 7/2002 | Miller | 414/723 |

FOREIGN PATENT DOCUMENTS

| | | |
|---|---|---|
| EP | 0 122 547 | 10/1984 |
| EP | 0 184 282 | 6/1986 |
| EP | 0 273 828 | 7/1988 |
| EP | 0 405 813 A2 A3 | 1/1991 |
| EP | 0 578 447 A1 | 1/1994 |
| FR | 2 701 047 | 8/1994 |
| FR | 0 769 590 A3 A3 | 4/1997 |
| FR | 2 760 029 | 8/1997 |
| GB | 1169062 | 10/1969 |
| GB | 2 177 674 A | 7/1985 |
| GB | 2 169 582 A | 1/1986 |
| GB | 2 205 299 A | 2/1988 |
| GB | 2 264 489 A | 2/1993 |
| GB | 2 268 464 | 6/1993 |
| GB | 1391050 | 6/1994 |
| GB | 1472685 | 5/1997 |
| WO | WO 95/00714 | 4/1975 |
| WO | WO 95/33895 | 6/1995 |

* cited by examiner

*Primary Examiner*—Thomas B. Will
*Assistant Examiner*—Meredith Petravick
(74) *Attorney, Agent, or Firm*—Stephen B. Salai, Esq.; Brian B. Shaw, Esq.; Harter, Secrest & Emery LLP

(57) ABSTRACT

A coupler (11) for connecting a dipper arm (3) of an excavator to a bucket (1) without need for the operator of the excavator to leave the cab of the excavator, the coupler (11) having a device for connecting it to the end of the dipper arm (3), and a latching hook (17) for connecting it to a bucket (1), wherein the latching hook (17) has a special internal profile (56, 57, 61) so that when it is supporting the weight of a bucket (1), it will tend to move to a latching position, not to an unlatching position.

8 Claims, 11 Drawing Sheets

COUPLER FOR BUCKET EXCAVATORS

BACKGROUND OF THE INVENTION

1. Field of the Invention

This invention relates to a coupler for bucket excavators, and which is provided with a special hook. The invention also extends to the construction of the hook.

2. Description of the Related Art

Hydraulically operated mechanical excavators have a dipper arm on the end of which are two mounting points by means of which an excavating bucket is pivotally attached to the end of the arm, and pivoted relative to the arm, respectively. Until relatively recently, if the operator wished to change the bucket, e.g. to a larger one, this had to be done manually. This involved the operator leaving the cab of the excavator, removing two pivot pins by means of which the bucket is connected to the dipper arm, getting back into the cab to lift the dipper arm clear of the bucket, aligning the dipper arm with the new bucket (and aligning the pivot apertures), de-mounting from the cab again, and locating the pivot pins in the aligned apertures, and securing them in place (e.g. with circlips, locking pins or bolts or the like) and then getting back into the cab to use the excavator. Sometimes, the operator would have considerable difficulty in removing or re-inserting the pivot pins, due to slight misalignment of the pivot apertures, and would have to use a heavy hammer for this purpose.

More recently, this time consuming exercise has been largely dispensed with, with the introduction of quick couplers which are located between the dipper arm and the bucket. The couplers can either be of the hydraulic type or of the mechanical type and are effectively permanently fitted to the two pivot aperture of the dipper arm and the bucket pivoting link, respectively. These couplers incorporate a generally horizontally and rearwardly extending hook-like aperture or jaw adapted to engage with one of the pivot pins on the bucket (both of which are left fitted to the bucket), and a generally downwardly extending aperture or jaw adapted to locate over the other pivot pin on the bucket, with which downwardly extending aperture a moveable latching hook is associated. See, for example, GB 2205299-A (Balemi). Another coupler is disclosed in U.S. Pat No. 5,692,325.

In manual versions of these couplers, the latching hook is biased by a coil spring to its latching position, and is moved away from its latching position by a release handle or lever rod which is removably locatable in an aperture in the nose of the latching hook.

In the hydraulic versions, a double acting hydraulic piston and cylinder device moves the latching hook between its respective positions, and a check valve is located within the piston and cylinder device to prevent inadvertent movement of the piston in the event of hydraulic failure.

However, in both the manual and hydraulic versions, a safety pin has to be provided which must be located by the excavator operator in specially provided aperatures in the coupler, to lock the latching hook in its latching position. This means that in both of these versions, the digger operator still has to leave his cab to secure in position the safety pin; this is inconvenient and time consuming.

In the known couplers, the hook has a profile which is such that, if the check valves fail and the hook: is carrying the weight of the bucket, the forces acting on the support pivot pin in the coupler are such that there is a moment about the pivot pin supporting the hook which will cause the hook to rotate to its unlatched position, thus releasing the bucket.

BRIEF SUMMARY OF THE INVENTION

It is an object of the present invention to provide a fully automatic coupler for an excavator bucket which has a special coupler hook which will not rotate to a release position when under load and which can be operated by the excavator operator from his cab and which does not require the fitting of a safety pin by hand. Thus the operator does not have to leave the cab to change buckets.

According to the present invention, as defined in claim 1, we provide a coupler to enable an excavator operator to couple an excavator bucket to a dipper arm of an excavator without the leaving of the excavator cab, the coupler being locatable, in use, between the bucket and the dipper arm and having two spaced plates with two apertures therein by means of which it can be coupled by pins to the dipper arm and bucket pivot link of the excavator respectively, a first open-ended hook-like aperture in the plates extending generally horizontally and rearwardly for engagement, in use, with a first pivot pin provided on an excavator bucket, a latching hook pivotally supported on the plates for latching engagement in use with a second pivot pin provided on the bucket once the first hook-like aperture has been engaged with the first pivot pin and power operated means for moving the latching hook, operable, in use, by the operator from the cab, said latching hook having an internal concave surface with a profile such that when the hook is carrying the weight of the bucket via the second pivot pin, there will be a moment on the latching hook tending to cause it to move to a latching position.

Preferably, said latching hook has a profile such that, in use, when the hook is carrying the weight of the bucket via the second pivot pin, the pin will move along the internal concave surface of the hook, from a first position tending to unlatch the hook, to one putting no unlatching force on the hook and thereafter to one tending to move the hook to a latching position.

For this purpose, the free end of the hook preferably has an upturned, extended nose, the inner face of which is concave and which is preferably connected to the normal concave internal surface of the hook by an internal planar portion.

In the hydraulic version, although the piston and cylinder device for the latching hook is provided with a check valve and the special latching hook is provided, it is important that maximum provision is made to ensure that a bucket cannot accidentally become disconnected from the coupler, and preferably therefore, the coupler is also provided with blocking means adjustably supported on the coupler. This may be moveable under its own weight by the force of gravity into a blocking position in which it prevents the latching hook from being disengaged from the second pivot pin on the bucket, in which case the blocking means further includes resiliently deformable means on the blocking means which, in use, will engage an abutment when the coupler is inverted (with the result that the blocking means will tend under its own weight to move away from its blocking position), such engagement resulting in the resiliently deformable means biasing the blocking means into its blocking position.

Preferably, the latching hook is operated by means of a double acting piston and cylinder device, one end of which is pivotally connected about a first pivot axis to the coupler, and the other end of which is pivotally connected to the latching hook.

In one construction, the blocking means comprises a bifurcated blocking bar, the two limbs of which are pivotally supported on the coupler, preferably on the said first pivot axis, and the opposite end of which bears against a face on the rear of the latching hook.

In another construction, the blocking means may comprise a single blocking bar pivotally supported at one end region on the coupler, preferably on the first pivot axis and adapted to bear at its opposite end against a face on the rear of the hook.

Preferably, the face is stepped so that the coupler can be used with different sized bucket pivot pin distances (known as pin spread).

Preferably, the resiliently deformable means comprises an upstanding resiliently deformable arm on the blocking bar which will bear against an abutment on the dipper arm when the coupler is inverted, e.g. when a bucket operating cylinder is retracted to pivot the bucket.

Preferably, a protection plate is fitted over the latching hook and blocking means, through which plate the resiliently deformable arm projects, the plate being provided to ensure that excavated material does not interfere with the operation of the blocking means. The plate may be welded or bolted in position. Hydraulic hoses for the double acting piston and cylinder device for operating the latching hook may pass through one or more apertures in the plate; alternatively the plate carries two hydraulic hose couplings, and on the inner side of the plate, the couplings are permanently connected by suitable hoses to the said piston and cylinder device. This allows further hoses leading from the main pressure system on the excavator to be connected and disconnected easily to the coupler.

BRIEF DESCRIPTION OF THE SEVERAL VIEWS OF THE DRAWINGS

A preferred embodiment of coupler according to the present invention is now described by way of example with reference to the accompanying drawings, in which.

DETAILED DESCRIPTION OF THE INVENTION

Figure 1:
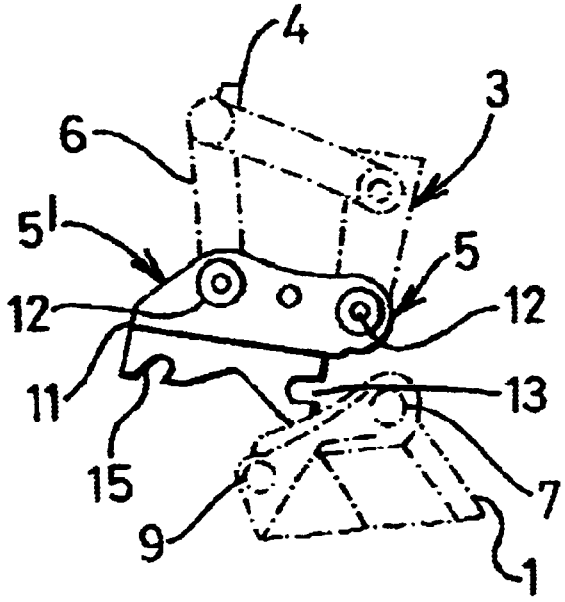
FIG. 1 (Prior art)
FIGS. 1 to 3 are schematic side elevations showing how a coupler is used to connect an excavator bucket to a dipper arm of an excavator.
Figure 2:
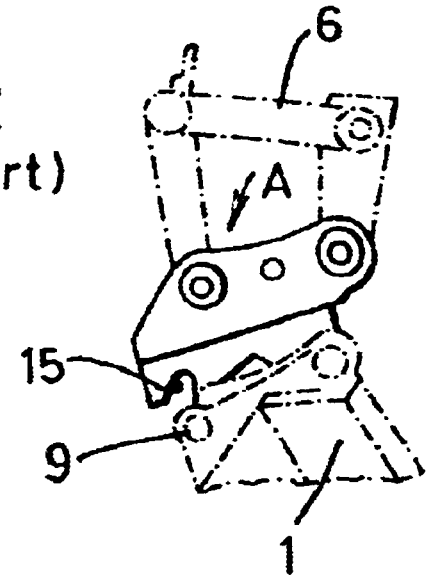
FIG. 2 (Prior art)

Referring to FIGS. 1 to 5 of the drawings, an excavator bucket is shown at 1, and the distal end of an excavator dipper arm is shown at 3. In accordance with standard practice, the dipper arm 3 supports a bucket piston and cylinder device 4 for controlling the bucket 1 via two pivot links 6, the bucket 1 normally being connected directly to the dipper arm 3 by means of a first pivot pin 7 carried by the bucket and engaging directly within a mounting point or pivot aperture in an end region of the dipper arm 3 and a second pivot pin 9 engaging directly within a mounting point or pivot aperture 5' in an end region of one of the links 6 (this arrangement is not shown).

Figure 3:
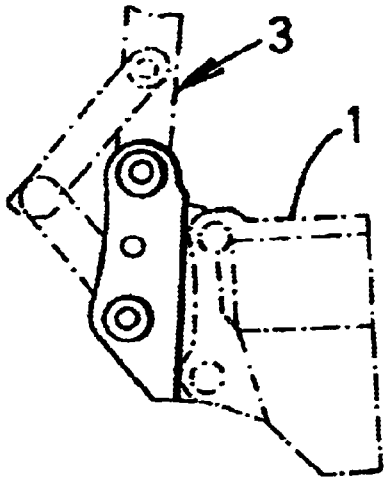
FIG. 3 (Prior art)

More recently, however, a coupler 11 has been used to enable the semi-automatic connection of the bucket 1 to the dipper arm 3 and as illustrated, the coupler has two mounting points thereon by means of which it is connected to the mounting points 5 and 5' on the dipper arm 3 and on the link 6 respectively, by suitable connecting pins 12. The coupler 11 is provided in a lower region thereof with a first generally horizontally and rearwardly extending aperture or jaw 13 and a second generally downwardly extending aperture or jaw 15. By rearwardly extending, we mean opening outwardly, in use, from the coupler towards the operator of an excavator on which the dipper arm and coupler are fitted and by downwardly extending we mean, in use, extending or opening outwards generally downwards towards the ground. In order to connect the bucket 1 to the dipper arm, the excavator operator manoeuvres the dipper arm to the position shown in FIG. 1 and then moves the dipper arm downwardly and rearwardly so as to engage the first aperture or jaw 13 with the first pivot pin 7, which is virtually permanently fitted to the bucket 1; he then operates the bucket-controlling piston and cylinder device 4 so as to swing the pivot links 6 downwardly, as represented by the arrow A in FIG. 2, so as to move the second aperture or jaw 15 into engagement with the second pivot pin 9, which is also virtually permanently secured to the bucket 1. The coupler is then latched in position so that the jaw 15 is clamped around the pin 9 and the bucket can be used for digging as illustrated in FIG. 3.

Figure 4:
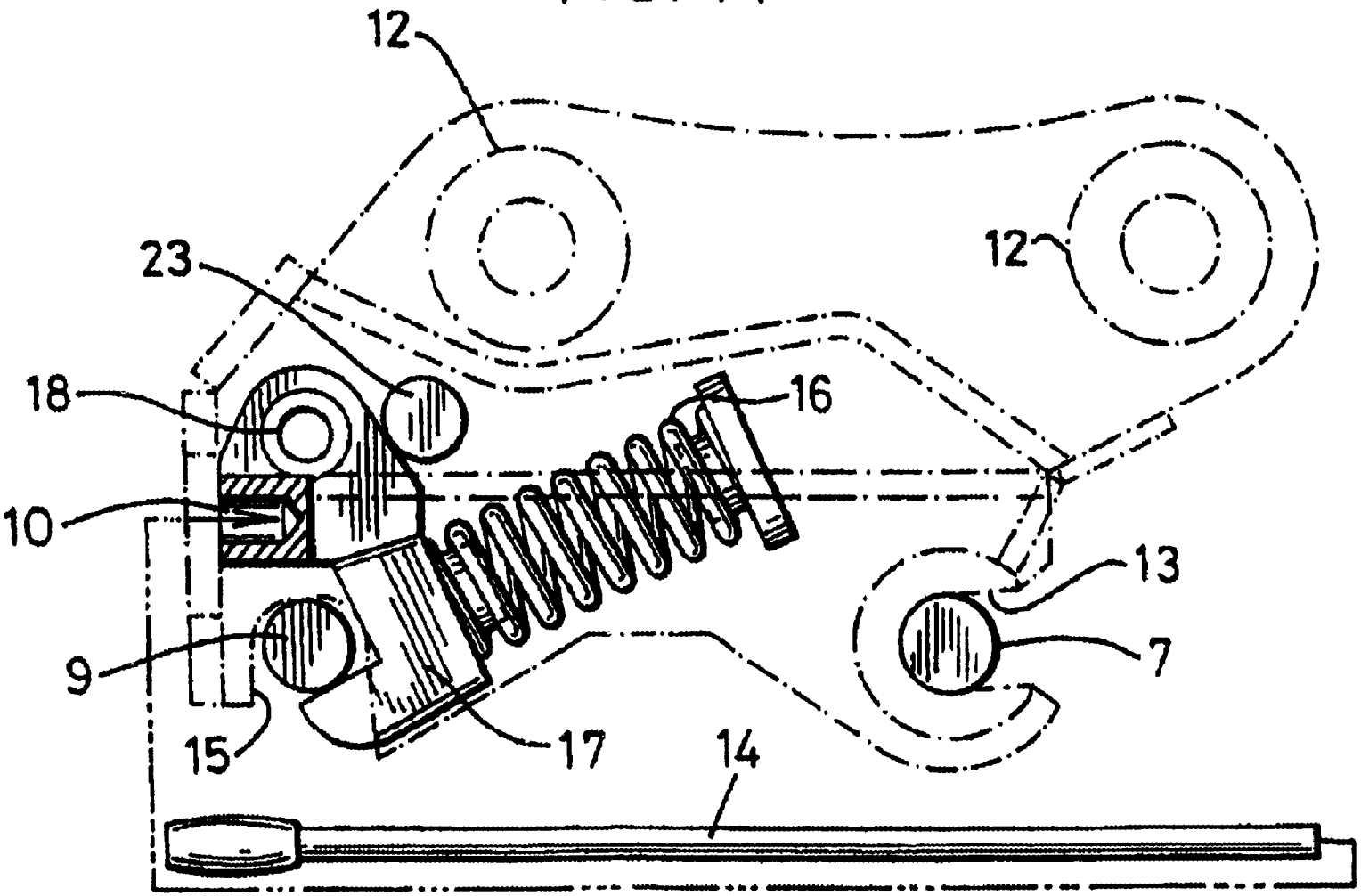
FIG. 4 (Prior art)
FIG. 4 is a partly schematic side elevation with parts broken away, showing details of a manual prior art coupler.

In FIG. 4, a manual prior art coupler is disclosed which is provided with a latching hook 17, pivotally supported on the body of the coupler about a pivot 18 and biased to a latching position (in which it maintains the pivot pin 9 in the aperture 15) by means of a coil spring 16. In order to move the hook 17 against the bias of the spring 16, e.g. to release the pivot pin 9 from the aperture 15 and thus to drop a bucket 1, a bar or release handle 14 has to be inserted into an aperture 10 in a nose portion of the hook 17 so that when downward pressure is applied to the end of the bar, the hook 17 will pivot about its pivot 18 accordingly.

Figure 5:
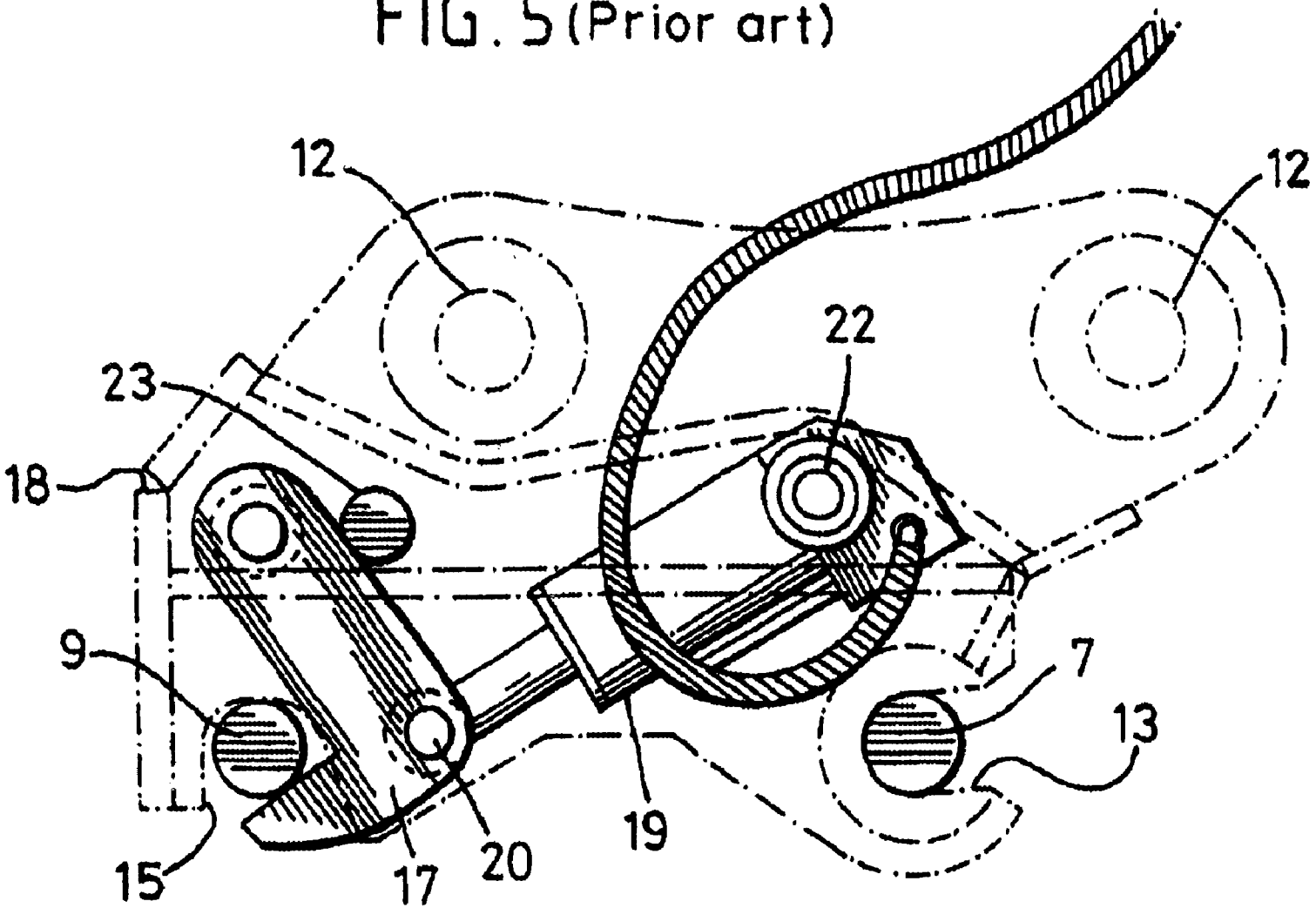
FIG. 5 (Prior art)
FIG. 5 is a view similar to FIG. 4 of a hydraulically operated prior art coupler.

In the hydraulic type of prior art coupler which is illustrated in FIG. 5, the latching hook 17 is moved between its illustrated latching position and a release position by means of a double-acting hydraulic piston and cylinder device 19, the piston of which is pivotally connected to the hook at 20 and the cylinder of which is pivotally connected to the body of the coupler at 22. A suitable check valve (not shown) is provided within the piston and cylinder device 19 in case there should be a failure in the hydraulic supply to the piston and cylinder device 19. However, in case the check valve should fail, or in the case of the manual coupler shown in FIG. 4, in case the spring 16 should fail, a safety pin 23 is always provided. This safety pin 23 bridges between the body or two side plates of the coupler 1 and a rear face of the latching hook 17 so as to hold the latching hook 17 in a latching position and prevent the bucket pivot 9 from being released from the aperture 15. The disadvantage with this arrangement is that every time the safety pin 23 has to be inserted or removed, the excavator operator has to dismount from the cab of the excavator. This is time consuming and inconvenient for the excavator operator and as a result, the operator often never fits the safety pin 23.

In accordance with the present invention, a special latching hook 17*a* is provided to overcome this problem. In the construction shown in FIG. 6, wherein parts of the coupler have been broken away for the sake of clarity, the safety pin of the prior art construction shown in FIG. 5 is dispensed with, the hook 17*a* is provided (and is described in greater detail with reference to FIGS. 9–11) and a further blocking means shown generally at 25 is also provided. The blocking means is in the form of a bifurcated blocking bar with two rearwardly extending limbs 26 which are pivotally supported on the pivot 22 by means of which the piston and cylinder device 19 is connected to the coupler 11, and a forward end 24 of which engages within a recess on a rear face of the latching hook 17*a*. The blocking means 25 moves into blocking engagement with the roller of the latching hook 17*a* under its own weight due to the force of gravity, causing it to pivot anticlockwise about the pivotal connection 22 under normal operating conditions of the coupler and excavator bucket. However, in the event of the bucket operating piston and cylinder device 4 being retracted so as to lift the bucket so as to pivot it clockwise about the mounting point 5 on the dipper arm 3, there will be a tendency for the blocking means 25 to become inoperative due to its own weight and accordingly, the blocking means 25 is provided on its rearmost end with resiliently deformable means 27 which is then activated to bias the forward end 24 of the blocking means into engagement with the rear face of the latching hook 17. This will hold the hook in its latching position to prevent inadvertent displacement of the second bucket pivot pin 9 from the aperture 15. In the preferred arrangement, the resiliently deformable means 27 is in the form of an upstanding leaf-spring 28, a free end portion of which will abut against an abutment on the dipper arm 3, thus producing a suitable reaction force to hold the blocking means 25 in engagement with the rear face of the hook 17*a*.

Figure 7:
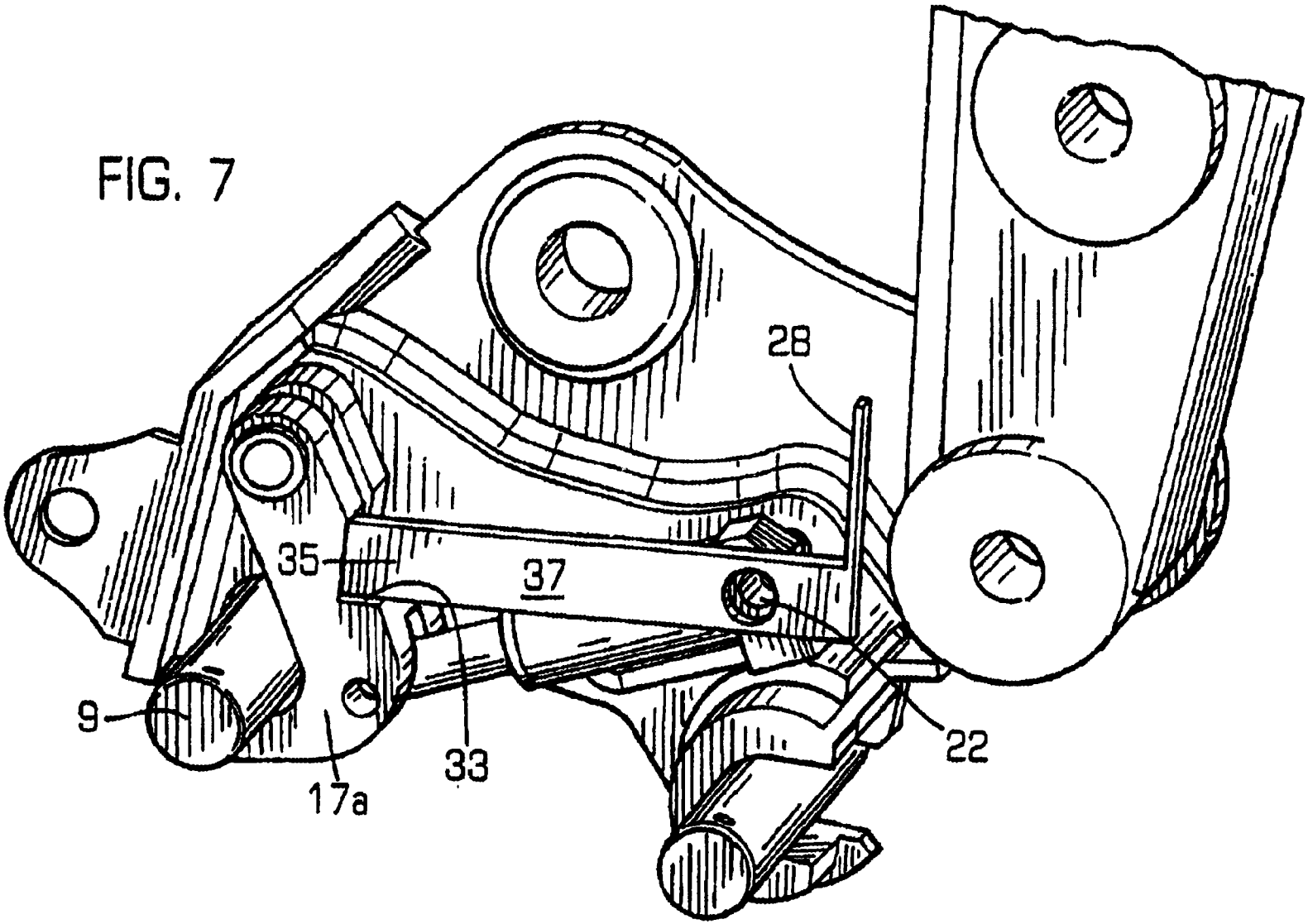
FIG. 7 is a view similar to FIG. 6 showing a modified coupler according to the invention.

In the alternative construction shown in FIG. 7, the bifurcated blocking bar with its two limbs 26 is replaced by a single blocking bar 37, which is pivotally connected to the pivot connection 22, as in the previous embodiment. Likewise, as in the previous embodiment, this single blocking bar 37 has an upstanding leaf-spring 28 connected thereto which operates as previously described. In the construction of FIG. 7, a forward end portion 35 of the blocking bar engages within a recess 33 in a rear face of the latching hook 17*a* to hold the latching hook 17*a* in its latching position but in other respects, the single blocking bar 37 acts in the same way, under its own weight, as in the previous embodiment.

Figure 8:
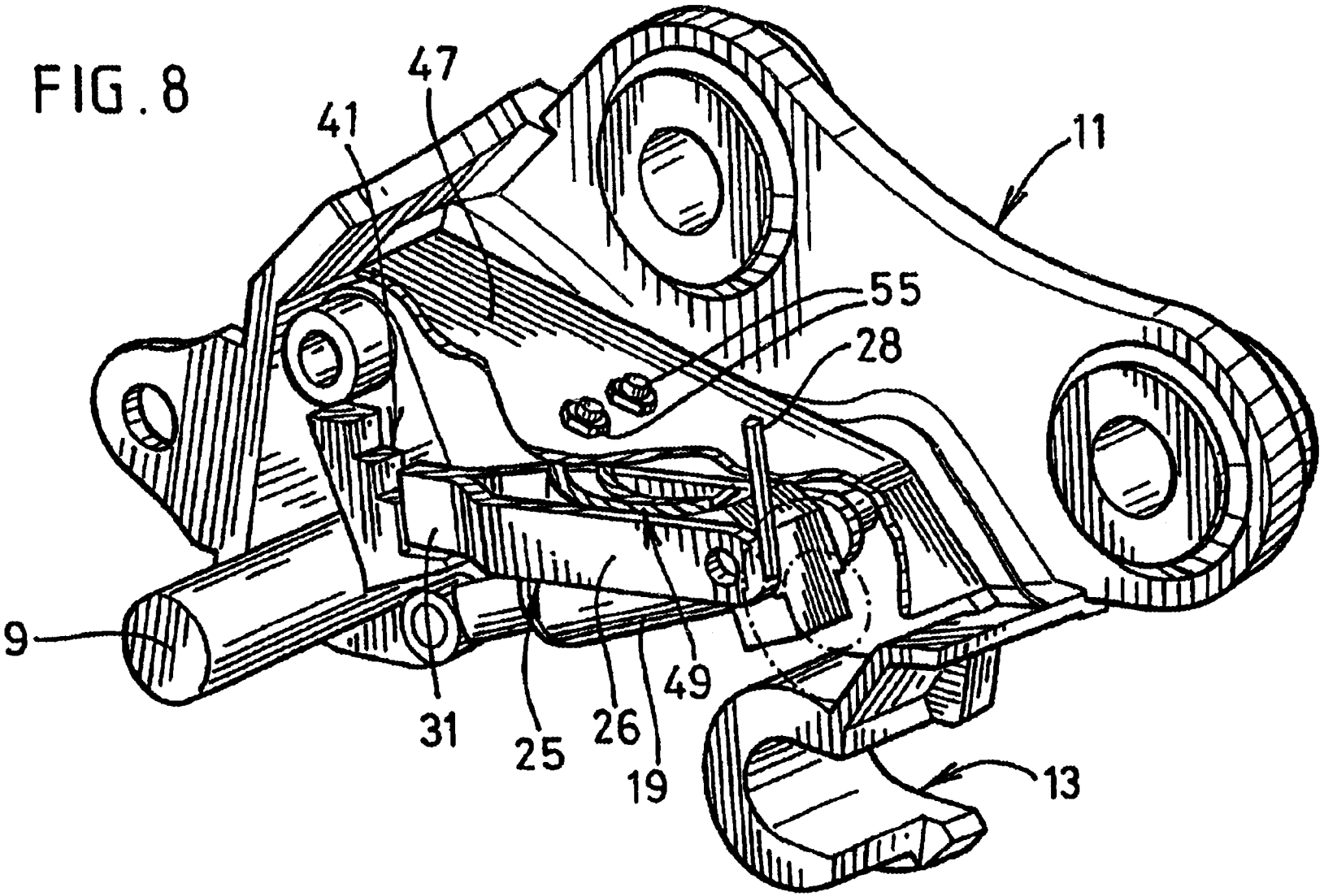
FIG. 8 is a further perspective view with parts, including the latching hook, omitted or cut away, showing two further preferred features of the invention.

In a preferred arrangement of the construction as shown in FIG. 8, a series of steps or recesses 41 are provided on a rear face of the latching hook 17*a* with which a modified forward end portion 31 of the latching means engage. As will be apparent from FIG. 8, the bucket pivot pin 9 shown therein is of a normal size, but by providing the series of steps on the rear face of the latching hook 17*a*, larger sizes of bucket pin 9, or different sized bucket pin pivot centres (known as pin spread) can be accommodated.

Figure 6:
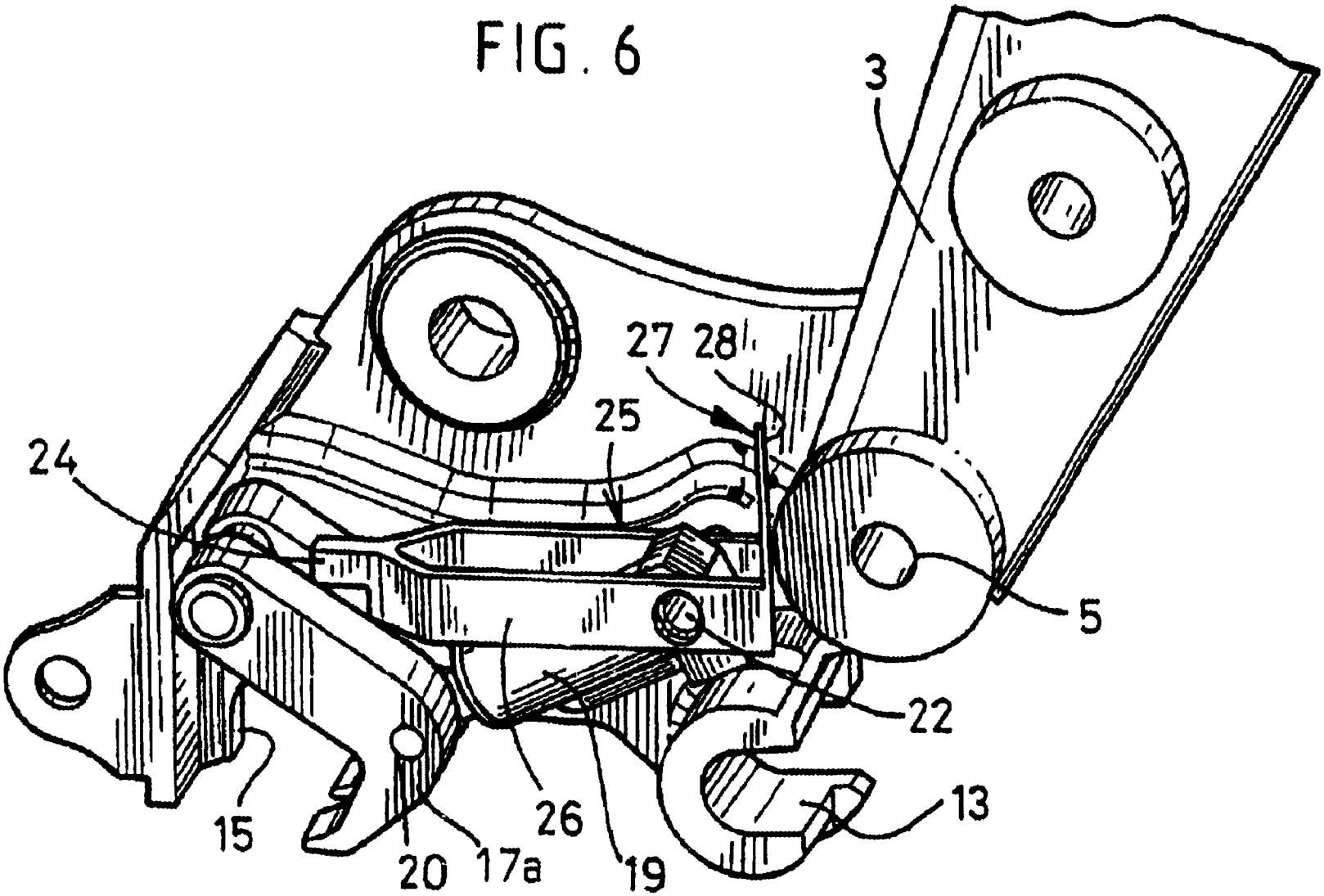
FIG. 6 is a perspective view with parts broken away showing a coupler according to the invention.

From the foregoing, it will be appreciated that the gravity operated blocking means 25 whether it be the construction shown in FIG. 6 or the construction shown in FIG. 7, or that shown in FIG. 8, allows an excavator operator to change buckets without leaving his cab. This is because the latching hook 17*a* is hydraulically actuated by means of the piston and cylinder device 19, which itself is provided with check valves to prevent movement of the piston therein in the event of hydraulic failure. However, even if there is a hydraulic failure and, the check valve also fails, then the blocking means 25 will still prevent the latching hook 17*a* moving to an unlatched position.

When the excavator operator wishes to change a bucket, it is necessary for the operator fully to extend the piston and cylinder device 4 for the bucket to rotate the coupler anticlockwise (as seen in the drawings) so as to move the bucket into a fully inverted position, wherein it is tucked beneath the dipper arm 3 (sometimes known as the crowd position) in which position the coupler 11 will be inverted and the blocking means 25 will then swing under its own weight due to the forces of gravity to an unlatching position. This will then allow the operator to retract fully the piston of the piston and cylinder device 19, thus moving the latching hook 17*a* to an unlatched position. When the bucket in this position, its weight will be supported largely completely on the leading edge (or teeth if fitted) and the operator can then by retracting the main bucket operating piston and cylinder device 4, roll the coupler 11 to a generally vertical position, thus allowing the second bucket pin 9 to swing out of the second aperture or jaw 15 (which is now generally rearwardly extending) whereupon, on further retraction of the piston and cylinder device 4, the coupler 11 will be moved back to its normal position, thus allowing the first pivot pin 7 to slide out of the rearwardly facing first aperture 13. This effectively disconnects the bucket from the coupler and allows the operator then to fit a different bucket to the dipper arm. These various different relative positions of dipper arm, coupler and excavator bucket are illustrated in the six different views comprising FIG. 12 of the drawings.

Because of the provision of the gravity operated blocking means 25, it is important to ensure that excavated material does not interfere with its satisfactory operation. Accordingly, we prefer to fit a protection plate 47 between the two side plates of the coupler 11, which completely overlies the blocking means 25 and the double acting hydraulic piston and cylinder device 19, as shown in FIG. 8. This plate 47 is preferably welded in position and accordingly, has an aperture therein through which the resiliently deformable leaf-spring 28 projects. Furthermore, two hydraulic hose connectors, are fitted to the plate, as shown at 55, to which hydraulic hoses 49 for the piston and cylinder device 19 are connected. On the upper exposed face of the plate 49, the connectors 55 are provided with fittings to receive connectors from further hydraulic hoses (not shown), which are secured to the dipper arm 3 and lead to the main pressure system on the excavator. Although the presence of the protection plate 47 prevents the ingress of excavated material to the interior of the coupler, the provision of the hydraulic connectors 55 still allows the coupling 11 to be disconnected from the dipper arm if required and when various parts of the coupler become worn, these can all simply be removed by dropping them downwardly from the coupler as shown in FIG. 8, since all the various pivot connections are easily removable from the coupler.

In spite of the various safety features described above, all enabling bucket exchange to be carried out from the cab of the excavator, there is still a slight risk that the latching hook 17*a* may, if it is of a known or prior art construction, swing to its unlatching position, thus allowing the bucket to be dropped from the dipper arm if there is a hydraulic failure, and the check valve in the piston and cylinder device 19 fails, and the gravity operated blocking means 25 fails for some reason or another. Accordingly, in the present invention we provide a modified latching hook which, under normal conditions, cannot swing to an unlatched position, due to the weight of the bucket pivot 9 thereon. This modified latch hook is shown in detail in FIGS. 9, 10 and 11.

Normally, with a prior art latching hook 17 such as shown in FIGS. 4 and 5, the weight of the bucket on the hook 17, which is transferred to the hook through the bucket pin 9, will cause the hook 17 to swing anticlockwise, due to the reaction force acting on the inner concave face of the hook, causing an anticlockwise moment (M) about the pivot support pin 18 for the hook. However, in accordance with the invention, the hook 17*a* shown in FIG. 9, instead of having an internal profile such as shown schematically in FIGS. 4 and 5, is provided not only with a first concave portion 56 and a planar portion 57, both of which are generally of known construction, but also with a second concave portion 61, by virtue of the presence of a nose portion 63 on the free end portion of the hook 17*a*. As can be seen from FIG. 9, when the bucket pin 9 is bearing down upon the first concave portion 56 of the hook, there will be reaction forces generated such that the moment acting on the hook 17*a* about its support pivot 18 is anticlockwise. However, as the coupler is tipped during operation, so that there is a tendency for the bucket 9 to move off the first concave surface 56 and onto the planar surface 57, reaction forces R1 and R2 will be generated, the two components of which, when combined, will eventually produce a composite force component which moves from the dotted line position 62, shown in FIG. 9, in the direction of the arrow B.

Figure 10:
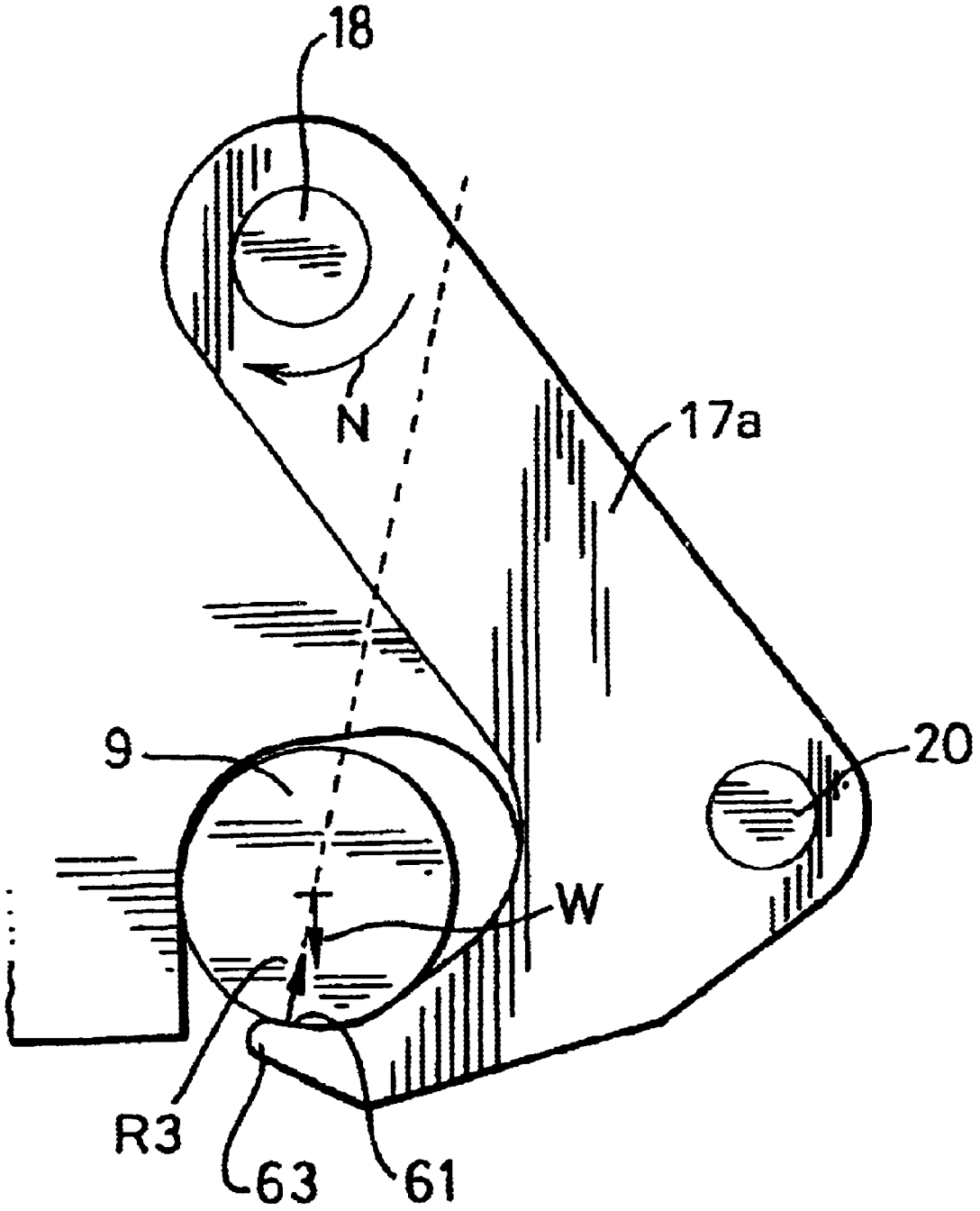
FIG. 10 is a view similar to FIG. 9, but showing the hook with the bucket pin in a slightly different position.

Eventually, as the pin 9 slides down the surface 57, the dotted line 62 will swing through the centre line of the pivot 18, whereupon there is no moment acting on the hook 17*a*, about the pivot 18. Subsequently, the whole weight (W) of the bucket pin 9 is supported on the second concave surface 61 on the interior of the nose portion 63 of the pin, whereupon the reaction force R2 disappears and the whole weight of the bucket is transferred to the bucket pin 9 to produce a reaction force R3, as shown in FIG. 10, which will result in a clockwise moment acting on the latching hook 17*a* about its support pivot 18, as represented by the arrow N. When this occurs, which is at the time when the pin 9 would appear to be at a position in which it was thought it would cause the latching hook 17*a* to move to its unlatched position, the weight of the bucket on the latching hook 17*a* in fact causes the latching hook not to move to an unlatching position, but to tend to move clockwise about its support pivot 18 to its latching position. This effectively means that if none of the safety systems previously described is correctly operating, it becomes impossible for the weight of the bucket to cause the latching hook to move to an unlatching position, because the shape of the internal surface of the newly provided tip portion 63 of the hook results in the moment N acting on the latching hook 17*a*, always to move the latching hook 17*a* towards a latching position.

Figure 9:
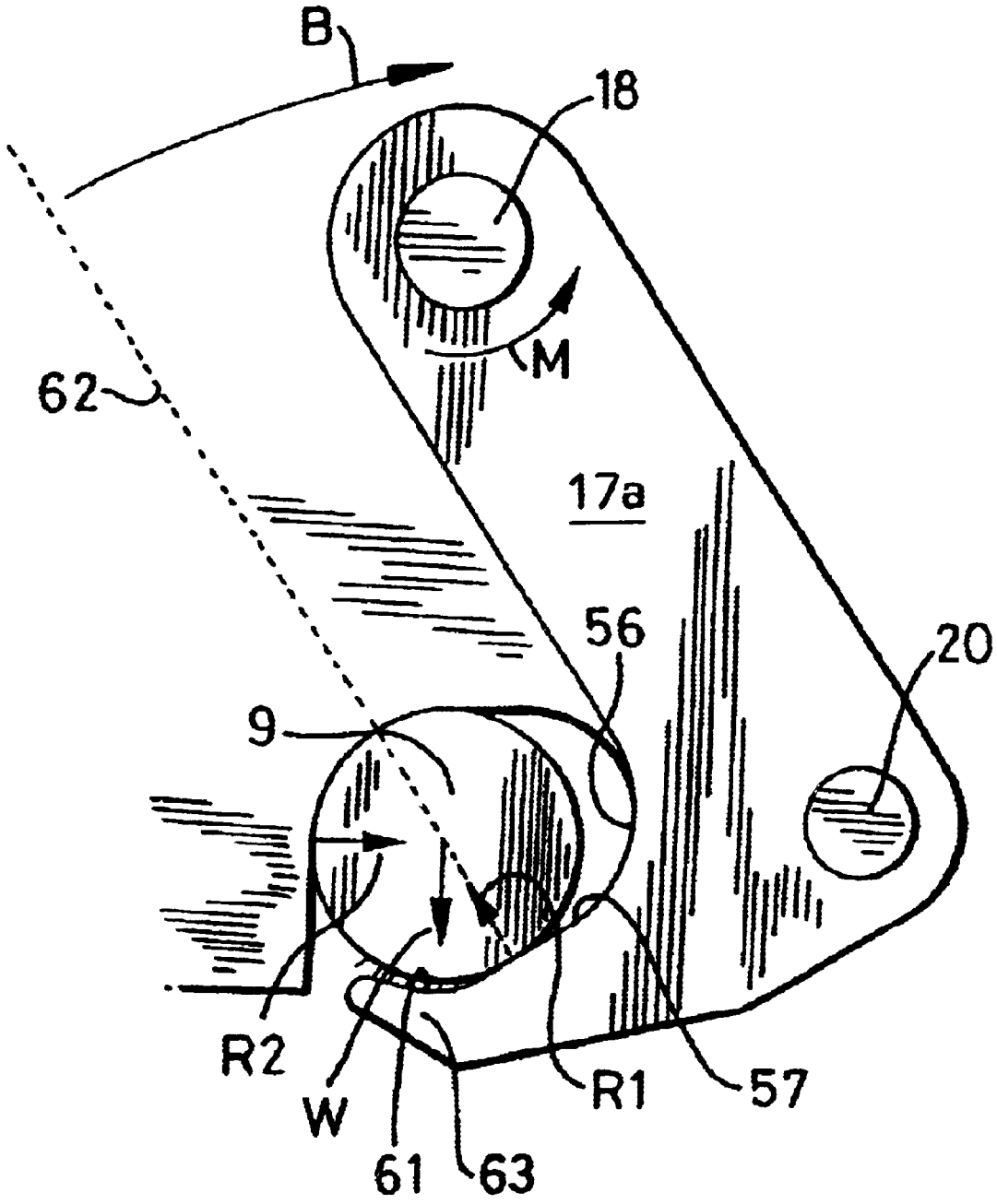
FIG. 9 is a scrap view showing to an enlarged scale a coupler latching hook incorporated in the coupler of FIGS. 6–8.
Figure 11:
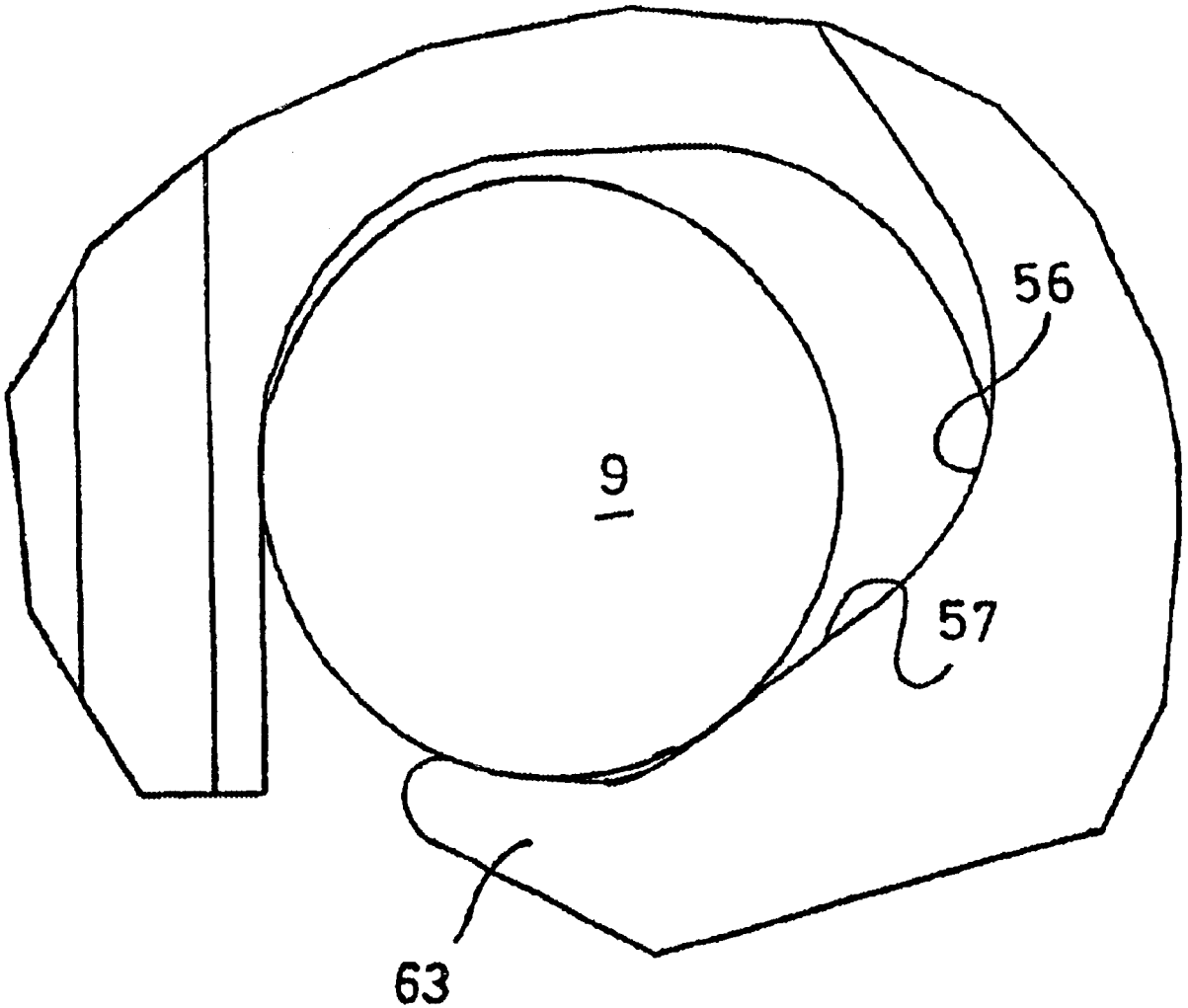
FIG. 11 is an enlarged view showing the hook and pin in its FIG. 10 position, and FIGS. 12 (1–6) shows schematically six different relative orientations of an excavator dipper arm, coupler and excavator bucket.
Figure 12:
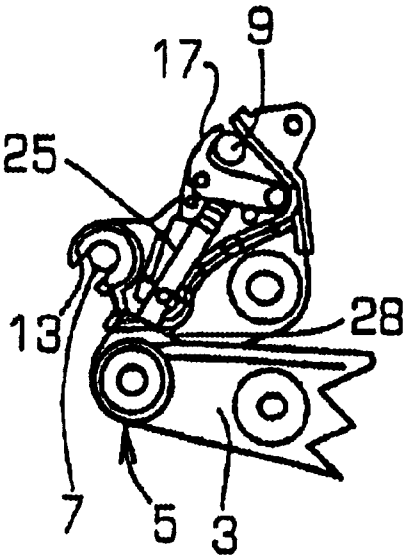
Figure 12:
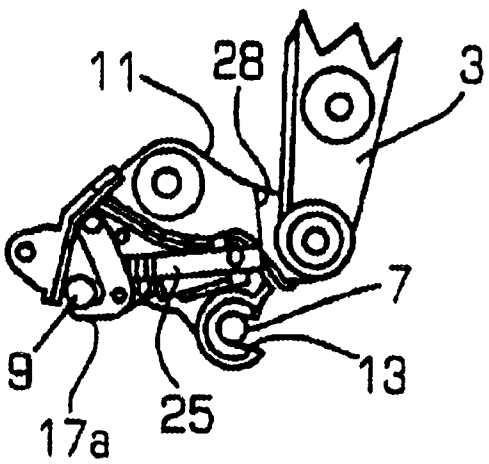
Figure 12:
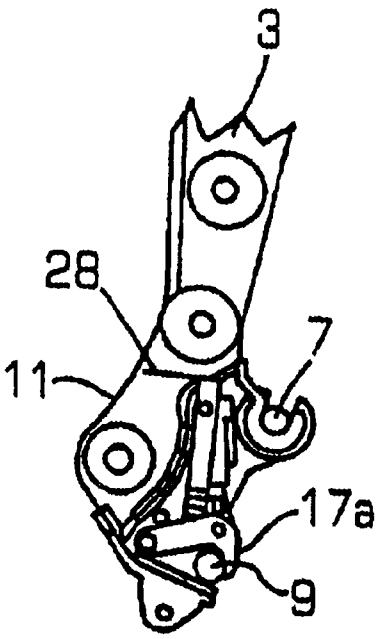
Figure 12:
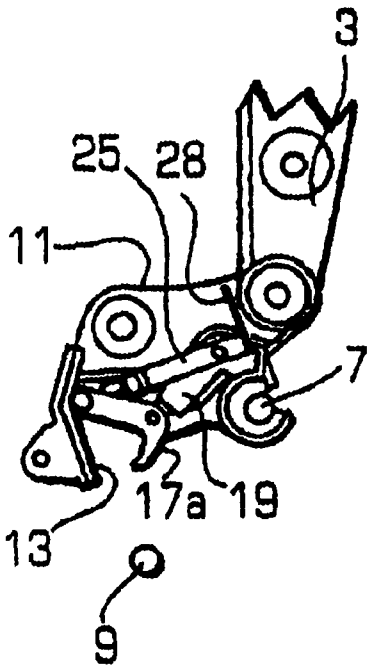
Figure 12:
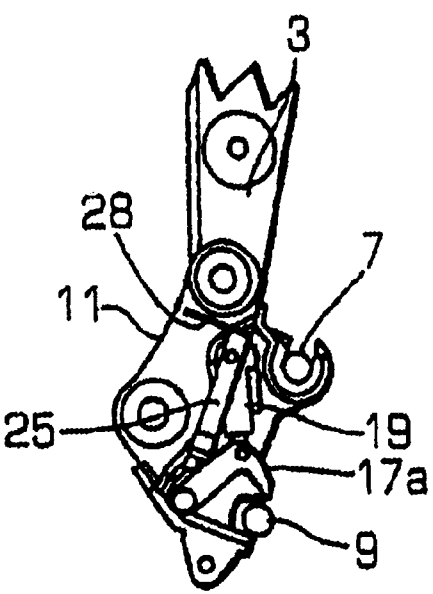
Figure 12:
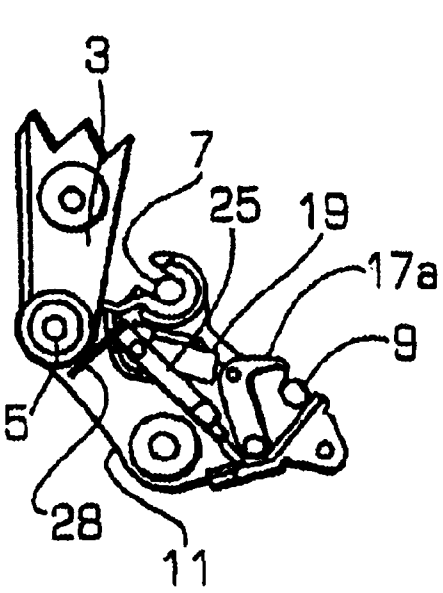

With the hook construction shown in FIGS. 9, 10 and 11, it is only possible to disconnect a bucket from the coupler in the manner previously described and illustrated in the various views of FIG. 12. In FIG. 12(1), the bucket piston and cylinder device 4 (not shown in this view) is fully retracted and the resiliently deformable leafspring 28 ensures that the blocking bar is kept in position against the hook 17*a*. In FIG. 12(2), the bucket piston and cylinder device 4 has been partially extended and the blocking bar is kept in the correct position by gravity. FIG. 12(3) shows the position that the coupler 11 takes up after the bucket piston and cylinder device has been further extended and, when in this position, the blocking bar remains in its blocking position due to gravity. FIG. 12(4) shows the position taken by the coupler 11 when the bucket (not shown) is in the fully crowded position, i.e. the coupler is inverted. In this position, the blocking bar will swing under gravity to an open position to allow the hook 17*a* to be retracted by operation of the piston and cylinder device 19. FIG. 12(5) shows the coupler 11 after it has been rolled to a position to allow the bucket pin 9 to swing clear of the coupler, whereas FIG. 12(6) shows how the bucket can then be removed by rolling the coupler 11 clockwise relative to its FIG. 12(5) position.

In other words, it is necessary first fully to rotate the coupler 11 anticlockwise about its mounting; point 5 on the end of the dipper arm 5, through the position shown in FIG. 12(3) to the fully tucked position shown in FIG. 12(4), when the weight of the bucket is fully supported on the ground. It is then possible, because there is no longer any weight whatsoever of the bucket carried by the latching hook 17*a*, to activate the piston and cylinder device 19 to swing the latching hook 17*a* to a fully unlatched position, as shown in the position of FIG. 12(4). The bucket can then be unlatched, as previously described and as illustrated by the positions of FIGS. 12(5) and 12(6).

It will, of course, be understood that the present invention has been described above purely by way of example, and modifications of detail can be made within the scope of the invention. For example, although the coupler is principally for coupling excavating buckets to the dipper arm, other attachments, such as concrete breakers, rippers and clamshells can be coupled to the dipper arm using the coupler, and the terms 'bucket' and 'buckets' should be interpreted accordingly. Furthermore, the coupler allows attachments from various different manufacturers in the same size excavator range to be used on a particular excavator.

Instead of having gravity operated blocking means, i.e. a blocking bar 26 or 37 moveable under its own weight, alternative constructions operable from the cab of the excavator could be provided, such as those described in our U.K. Patent Application No. 2330570.

What is claimed is:

1. A coupler for permitting an excavator operator to couple an excavator bucket to a dipper arm of an excavator without the operator leaving an excavator cab, the excavator including a bucket pivot link, and the coupler being operably disposed between the excavator bucket and the dipper arm, the coupler comprising:

(a) two spaced plates, each plate having two apertures selected to cooperatively align with the dipper arm and the bucket pivot link of the excavator respectively, a first open-ended hook-shaped aperture in the two spaced plates extending generally horizontally and rearwardly;

(b) a latching hook pivotally supported on the spaced plates between a latching position and an unlatched position; the latching hook having a free end, the free end including a nose portion and an internal surface, the nose portion and the internal surface defining an internal profile, the internal profile including an internal surface of the nose portion, oriented such that when the hook is cooperatively engaged with the excavator bucket and carrying the weight of the excavator bucket on the internal surface of the nose portion, a moment is created on the latching hook urging the latching hook toward the latching position; and (c) power operated means actuatable from within the excavator cab for moving the latching hook between the latching position and the unlatched position.

2. The coupler according to claim 1, wherein the internal profile is such that, in use, when the hook is carrying the weight of the bucket via a second pivot pin, the second pivot pin can move along an internal concave surface of the latching hook, from a first position engaging a first arcuate profile and tending to unlatch the hook, to a second position inducing no unlatching force on the latching hook and thereafter to the internal surface of the nose portion for tending to move the latching hook to the latching position.

3. The coupler according to claim 1, wherein the nose portion on the free end of the latching hook has an upturned, extended nose defining a concave inner face.

4. A coupler according to claim 3, wherein the concave inner face is connected to the first arcuate profile by an internal planar portion.

5. A coupler to enable an excavator operator to couple an excavator bucket to a dipper arm of an excavator without the leaving of the excavator cab, the coupler being located, in use, between the bucket and the dipper arm and having two spaced plates with two apertures therein by means of which it can be coupled by pins to the dipper arm and bucket pivot link of the excavator respectively, a first open-ended hook-like aperture in the plates extending generally horizontally and rearwardly for engagement, in use, with a first pivot pin provided on the excavator bucket, a latching hook pivotally supported on the plates for latching engagement in use with a second pivot pin provided on the bucket once the first hook-like aperture has been engaged with the first pivot pin and power operated means for moving the latching hook, operably, in use, by the operator from the cab said latching hook has a nose portion on the free end of the hook and an internal surface with different profiles, including a first arcuate profile and a second profile internally of the nose portion such that when the hook is carrying the weight of the bucket via the second pivot pin and the pin is in engagement with the second profile internally of the nose portion, there will be a moment on the latching hook tending to cause it to move to a latching position.

6. A coupler according to claim 5, wherein said latching hook has a profile such that, in use, when the hook is carrying the weight of the bucket via the second pivot pin, the pin can move along an internal concave surface of the hook, from a first position engaging the first arcuate profile and tending to unlatch the hook, to one putting no unlatching force on the hook and thereafter to said second profile tending to move the hook to the latching position.

7. A coupler according to claim 3, wherein the nose portion on the free end of the hook has an upturned, extended nose, the inner face of which is concave.

8. A coupler according to claim 7, wherein the inner concave face is connected to the first arcuate profile of the internal surface of the hook by an internal planar portion.

* * * * *